US007607311B2

(12) United States Patent
Lee

(10) Patent No.: US 7,607,311 B2
(45) Date of Patent: Oct. 27, 2009

(54) METHOD FOR CONTROLLING AMOUNT OF REFRIGERANT OF DUAL TYPE UNITARY AIR CONDITIONER

(75) Inventor: Won Hee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 600 days.

(21) Appl. No.: 11/398,642

(22) Filed: Apr. 6, 2006

(65) Prior Publication Data

US 2007/0044489 A1 Mar. 1, 2007

(30) Foreign Application Priority Data

Aug. 24, 2005 (KR) ..... 10-2005-0077947

(51) Int. Cl.
*F25B 45/00* (2006.01)

(52) U.S. Cl. ..... 62/149; 62/228.5

(58) Field of Classification Search ..... 62/149, 62/228.5, 510

See application file for complete search history.

(56) References Cited

U.S. PATENT DOCUMENTS 4,932,220 A * 6/1990 Inoue ..... 62/175
6,742,348 B2 6/2004 So et al.
6,843,067 B2 1/2005 Lee et al.
2004/0011064 A1* 1/2004 Lee et al. ..... 62/160
2005/0081537 A1 4/2005 Hwang et al.
2005/0081539 A1* 4/2005 Hwang et al. ..... 62/160
2005/0081543 A1* 4/2005 Oh et al. ..... 62/198

* cited by examiner

*Primary Examiner*—Melvin Jones
(74) *Attorney, Agent, or Firm*—Birch, Stewart, Kolasch & Birch, LLP

(57) ABSTRACT

A method for controlling the amount of a refrigerant of a dual type unitary air conditioner, which has a plurality of centralized warm and cold air circulators and at least one individual warm and cold air circulator, includes inputting the operation capacity of compressors of an outdoor unit of the dual type unitary air conditioner; setting a superheating temperature of the individual warm and cold air circulator to a relatively low value when the operation capacity is large, and setting the superheating temperature of the individual warm and cold air circulator to a relatively high value when the operation capacity is small; and controlling the amount of the refrigerant supplied to the individual warm and cold air circulator according to the superheating temperature, thereby appropriately maintaining the amount of the refrigerant supplied to the individual warm and cold air circulator provided in a designated place and thus forming the optimized refrigerant cycle.

20 Claims, 7 Drawing Sheets

METHOD FOR CONTROLLING AMOUNT OF REFRIGERANT OF DUAL TYPE UNITARY AIR CONDITIONER

BACKGROUND OF THE INVENTION

1. Field of the Invention

The present invention relates to a dual type unitary air conditioner, and more particularly to a method for controlling the amount of a refrigerant of a dual type unitary air conditioner using a centralized heating and cooling system and an individual heating and cooling system so that the appropriate amount of a refrigerant is supplied to an individual warm and cold air circulator under the condition that the supercooled state of the refrigerant having passed through the individual warm and cold air circulator and the overloaded state of the individual warm and cold air circulator are prevented.

2. Description of the Related Art

Generally, a unitary air conditioner is a type of centralized heating and cooling system, which generates hot air or cool air using a heating and cooling unit installed in a basement of a building, such as a factory, an office, a hotel, or a house, and transfers the air to individual spaces through ducts installed in a wall of the building.

The unitary air conditioner has zone controllers installed in the ducts for divisionally independently supplying warm or cold air to regions required to be heated and cooled and regions not required to be heated and cooled, or a plurality of heating and cooling units independently installed in proportion to the number of the regions.

FIG. 1 is a schematic view of a conventional unitary air conditioner, FIG. 2 is a circuit diagram of the conventional unitary air conditioner, FIG. 3 is a schematic view of another conventional unitary air conditioner, and FIG. 4 is a circuit diagram of the conventional unitary air conditioner.

As shown in FIGS. 1 and 2, a conventional unitary air conditioner comprises one outdoor unit 1 fixedly installed at the outside of a building (a two-story house in the drawings), a warm and cold air circulator 2 connected to a first heat exchanger 1*b* of the outdoor unit 1 and fixedly installed in a basement or an outbuilding of the building, an air supply duct 3 and an air discharge duct 4 respectively connected to an air supply hole and an air discharge hole of the warm and cold air circulator 2 and divisionally buried in a wall of each of stories of the building, and zone controllers 5*a*~5*d* installed in the air supply duct 3 and the air discharge duct 4 for controlling air supplied to each of the stories and air discharged from each of the stories.

The outdoor unit 1 comprises at least one compressor 1*a* installed in a case for compressing a refrigerant gas, the first heat exchanger 1*b* connected to the compressor 1*a* by a refrigerant pipe for condensing the refrigerant gas (in a cooling mode) or absorbing latent heat (in heating mode), an expansion device 1*c* for decompressing and expanding the refrigerant gas, and an outdoor fan (not shown) for supplying external air to the first heat exchanger 1*b* to increase the heat exchange capacity of the first heat exchanger 1*b*.

The warm and cold air circulator 2 comprises a second heat exchanger 2*a* installed in a case and having one end connected to the first heat exchanger 1*b* and the other end connected to the expansion device 1*c*, and an air supply fan (not shown) located at the lower stream of the second heat exchanger 2*a* for guiding warm air or cold air to the air supply duct 3. The case of the warm and cold air circulator 2 has an air channel having an approximately U shape so that the second heat exchanger 2*a* and the air supply fan (not shown) are installed in the air channel. The air supply duct 3 is connected to an air supply hole of the air channel, and the air discharge duct 4 is connected to an air discharge hole of the air channel.

As described above, the air supply duct 3 and the air discharge duct 4 are respectively connected to the air supply hole and the air discharge hole of the warm and cold air circulator 2, and are divisionally branched into unit ducts buried in corresponding regions $Z_1$ and $Z_2$. Discharge ports 3*a* for supplying warm air or cold air to the corresponding regions $Z_1$ and $Z_2$, and intake ports 4*a* for sucking internal air for circulation are respectively formed through the unit ducts of the air supply duct 3 and the air discharge duct 4.

The zone controllers 5*a*~5*d* are valves installed in the unit ducts of the air supply duct 3 and the air discharge duct 4 buried in the corresponding regions $Z_1$ and $Z_2$ so that warm air or cold air can be divisionally supplied to the corresponding regions $Z_1$ and $Z_2$. The zone controllers 5*a*~5*d* are connected to a controller (not shown) and are automatically manipulated so that the zone controllers 5*a*~5*d* can be switched on/off by detecting temperatures or humidities of the corresponding regions $Z_1$ and $Z_2$ and comparing the detected temperatures or humidities to predetermined values, or are manually manipulated.

The above heat pump-type unitary air conditioner having the zone controllers 5*a*~5*d* will be operated as follows.

That is, in a two-story house, loads of respective stories (the corresponding regions) $Z_1$ and $Z_2$ are detected. When it is determined that both the detected loads of the respective stories $Z_1$ and $Z_2$ are more than a predetermined value, the unit ducts of the air supply duct 3 simultaneously supply warm air or cold air to the respective stores $Z_1$ and $Z_2$, and when it is determined that one of the detected loads of the respective stories $Z_1$ and $Z_2$ is more than the predetermined value, the corresponding unit duct of the air supply duct 3 supplies warm air or cold air to the story $Z_1$ or $Z_2$.

For example, in a cooling mode, the compressor 1*a* of the outdoor unit 1 is driven to compress the refrigerant gas into a high-temperature and high-pressure state, and the refrigerant gas is condensed into a high-temperature and high-pressure liquid state by the first heat exchanger 1*b* of the outdoor unit 1, is converted into a low-temperature and low-pressure state by the expansion device 1*c* of the outdoor unit 1. Then, the refrigerant passes through the second heat exchanger 2*a* of the warm and cold air circulator 2 so that the refrigerant gas exchanges heat with air sucked into the air channel through the air discharge duct 4, thereby generating cold air. The cold air is supplied to the air supply duct 3 through an inlet of the air supply fan (not shown). Here, when all the loads of the respective stories $Z_1$ and $Z_2$ are more than the predetermined value, the zone controllers 5*a*~5*d*, which are automatically manipulated, are opened by the controller, or the zone controllers 5*a*~5*d*, which are manually manipulated, are opened by the manipulation of a user. Thereby, the cold air generated by the warm and cold air circulator 2 is supplied to the respective unit ducts of the air supply duct 3, and is converted into a gaseous state by evaporation, thus cooling the respective stories $Z_1$ and $Z_2$. on the other hand, when one of the loads of the respective stories $Z_1$ and $Z_2$ is less than the predetermined value, the zone controllers 5*a*~5*d*, which are installed in the story $Z_1$ or $Z_2$, the load of which is not less than the predetermined value, are automatically or manually opened. Thereby, the cold air is supplied only to the unit ducts of the air supply duct 3 installed in the corresponding story $Z_1$ or $Z_2$, thus cooling the corresponding story $Z_1$ or $Z_2$.

The operation of the heat pump-type unitary air conditioner having the zone controllers 5*a*~5*d* in a heating mode is the same as that in the cooling mode except that the circulation of the refrigerant in the heating mode is performed in the reverse order according to a heat pump-type refrigerating cycle.

The above conventional unitary air conditioner having the zone controllers 5*a*~5*d* selectively supplies warm air or cold air according to a variation of the temperatures of the corresponding regions $Z_1$ or $Z_2$ using one indoor unit 1, thus reducing a power consumption rate. However, the above unitary air conditioner has a difficulty in installing new zone controllers in the air supply duct 3 and the air discharge duct 4 when an additional warm and cold air circulator is installed in a space having a high load (for example, a kitchen, an attic, or an exercise chamber). Further, the above unitary air conditioner is operated using a centralized heating and cooling system and thus has a limit in the capacity of the warm and cold air circulator 2, thereby causing a deterioration of efficiency.

In view of the above problem, FIGS. 3 and 4 illustrate another conventional unitary air conditioner. This unitary air conditioner does not comprise zone controllers, but comprises a plurality of outdoor units and a plurality of warm and cold air circulators independently installed according to the respective regions $Z_1$ or $Z_2$.

That is, the above unitary air conditioner comprises a first outdoor unit 11, a first warm and cold air circulator 12, a first air supply duct 13, and a first air discharge duct 14, which are used to heat and cool a first story of a two-story house, and a second outdoor unit 21, a second warm and cold air circulator 22, a second air supply duct 23, and a second air discharge duct 24, which are used to heat and cool a second story of a two-story house.

The first outdoor unit 11 comprises a first compressor 11*a*, a first heat exchanger 11*b* connected to the first compressor 11*a* by a four-way valve, and a first expansion device 11*c* connected to the first heat exchanger 11*b*.

The first warm and cold air circulator 12 comprises a third heat exchanger 12*a* connected to the first expansion device 11*c*, and a first air supply fan (not shown) installed at the lower stream of the third heat exchanger 12*a*.

The second outdoor unit 21 comprises a second compressor 21*a*, a second heat exchanger 21*b* connected to the second compressor 21*a* by a four-way valve, and a second expansion device 21*c* connected to the second heat exchanger 21*b*.

The second warm and cold air circulator 22 comprises a fourth heat exchanger 22*a* connected to the second expansion device 21*c*, and a second air supply fan (not shown) installed at the lower stream of the fourth heat exchanger 22*a*.

The above independent unitary air conditioner will be operated as follows.

That is, in a cooling mode in a two-story house, when loads of respective stories $Z_1$ and $Z_2$ are more than a predetermined value, the first compressor 11*a* and the second compressor 21*a* are simultaneously operated so that the refrigerant is compressed into a high-temperature and high-pressure gaseous state by the first and second compressors 11*a* and 21*a*, and the refrigerant is condensed into a high-temperature and high-pressure liquid state by the first heat exchanger 11*b* and the second heat exchanger 21*b*. The obtained refrigerant gas is converted into a low-temperature and low-pressure state by the first and second expansion devices 11*c* and 21*c* and supplied to the third heat exchanger 12*a* and the fourth heat exchanger 22*a* so that the refrigerant gas is evaporated by air introduced through the air discharge ducts 14 and 24 of the first and second warm and cold air circulators 12 and 22, thereby generating cold air. The cold air is supplied to the first air supply duct 13 and the second air supply duct 23 through the first air supply fan (not shown) and the second air supply fan (not shown), and is supplied to the respective stores $Z_1$ and $Z_2$ through the first and second air supply ducts 13 and 23, thereby cooling the respective stores $Z_1$ and $Z_2$. Then, the air is repeatedly circulated to the warm and cold air circulators 12 and 22 through the first and second discharge ducts 14 and 24 of the stores $Z_1$ and $Z_2$.

The operation of the above unitary air conditioner in a heating mode is the same as that in the cooling mode except that the circulation of the refrigerant in the heating mode is performed in the reverse order according to a heat pump-type refrigerating cycle.

The above conventional unitary air conditioner does not require zone controllers in the first and second air supply and discharge ducts 13, 23, 14, and 24, thus being easily installed and controlled. Further, this conventional unitary air conditioner independently heats and cools the regions $Z_1$ and $Z_2$, thus having excellent efficiency. However, the above unitary air conditioner has a difficulty in installing an additional warm and cold air circulator in a space having a high load. Further, the above unitary air conditioner has the outdoor units 11 and 21 independently installed in the regions $Z_1$ and $Z_2$, thus increasing production costs.

In order to maintain control temperatures in the respective regions, i.e., indoor temperatures, to a predetermined temperature desired by a user, it is necessary to control the operation capacity of the compressors of the above two conventional unitary air conditioners corresponding to the total load amounts of the respective regions and to control the amount of the refrigerant passing through the respective indoor heat exchangers by adjusting the opening degrees of the electric valves.

SUMMARY OF THE INVENTION

Therefore, the present invention has been made in view of the above problems, and it is an object of the present invention to provide a method for controlling the amount of a refrigerant of a dual type unitary air conditioner, in which the amount of the refrigerant supplied to the individual warm and cold air circulator installed at a designated place is optimally maintained when the refrigerant is distributed to centralized warm and cold air circulators and the individual warm and cold air circulator, thereby forming the optimized refrigerant cycle.

In accordance with one aspect of the present invention, the above and other objects can be accomplished by the provision of a method for controlling the amount of a refrigerant of a dual type unitary air conditioner, which has a plurality of centralized warm and cold air circulators and at least one individual warm and cold air circulator, comprising: inputting an operation capacity of compressors of an outdoor unit of the dual type unitary air conditioner; setting a superheating temperature of the individual warm and cold air circulator to a relatively low value when the operation capacity is large, and setting the superheating temperature of the individual warm and cold air circulator to a relatively high value when the operation capacity is small; and controlling the amount of the refrigerant supplied to the individual warm and cold air circulator according to the superheating temperature.

The control of the amount of the refrigerant may be performed so that a difference of temperatures between the refrigerant supplied to an indoor heat exchanger of the individual warm and cold air circulator and the refrigerant discharged from the indoor heat exchanger of the individual warm and cold air circulator maintains the set superheating temperature.

The centralized warm and cold air circulators may be independently installed in corresponding regions of a building, in which the dual type unitary air conditioner is installed, so that the number of the centralized warm and cold air circulators coincides with the number of the regions, and be independently connected in parallel to an outdoor heat exchanger.

The individual warm and cold air circulator may be independently installed in a designated place, and be independently connected in parallel to an outdoor heat exchanger.

A plurality of the compressors individually or simultaneously operated according to a load in the building may be connected in parallel.

A plurality of the compressors may have different capacities.

A plurality of the compressors may be operated by different methods.

In accordance with another aspect of the present invention, there is provided a method for controlling the amount of a refrigerant of a dual type unitary air conditioner, which has a plurality of centralized warm and cold air circulators independently installed in corresponding regions of a building, in which the dual type unitary air conditioner is installed, so that the number of the centralized warm and cold air circulators coincides with the number of the regions, and independently connected in parallel to an outdoor heat exchanger, and at least one individual warm and cold air circulator independently installed in a designated place and independently connected in parallel to the outdoor heat exchanger, comprising: inputting an operation capacity of compressors of an outdoor unit of the dual type unitary air conditioner; setting a superheating temperature of the individual warm and cold air circulator to a relatively low value when the operation capacity is large, and setting the superheating temperature of the individual warm and cold air circulator to a relatively high value when the operation capacity is small; and controlling the amount of the refrigerant supplied to the individual warm and cold air circulator according to the superheating temperature.

The control of the amount of the refrigerant may be performed so that a difference of temperatures between the refrigerant supplied to an indoor heat exchanger of the individual warm and cold air circulator and the refrigerant discharged from the indoor heat exchanger of the individual warm and cold air circulator maintains the set superheating temperature.

A plurality of the compressors individually or simultaneously operated according to a load in the building may be connected in parallel.

A plurality of the compressors may have different capacities.

A plurality of the compressors may be operated by different methods.

The compressors may comprise a first compressor having a capacity corresponding to 60% of the total compressor capacity, and a second compressor having a capacity corresponding to 40% of the total compressor capacity; in the case that at least one of the centralized warm and cold air circulators and the at least one individual warm and cold air circulator are simultaneously operated, when the compressors are selectively operated so that the total operation capacity of the selected compressor(s) corresponds to 100% of the total operation capacity of the compressors, the superheating temperature of the individual warm and cold air circulator may be set to 0° C., when the compressors are selectively operated so that the total operation capacity of the selected compressor(s) corresponds to 60% of the total operation capacity of the compressors, the superheating temperature of the individual warm and cold air circulator may be set to 1° C., and when the compressors are selectively operated so that the total operation capacity of the selected compressor(s) corresponds to 40% of the total operation capacity of the compressors, the superheating temperature of the individual warm and cold air circulator may be set to 2° C.; and in the case that only the at least one individual warm and cold air circulator is operated, when the compressors are selectively operated so that the total operation capacity of the selected compressor(s) corresponds to 40% of the total operation capacity of the compressors, the superheating temperature of the individual warm and cold air circulator may be set to 3° C.

The control of the amount of the refrigerant may be performed so that a difference of temperatures between the refrigerant supplied to an indoor heat exchanger of the individual warm and cold air circulator and the refrigerant discharged from the indoor heat exchanger of the individual warm and cold air circulator maintains the set superheating temperature.

In accordance with yet another aspect of the present invention, there is provided a method for controlling the amount of a refrigerant of a dual type unitary air conditioner, which has a plurality of centralized warm and cold air circulators, at least one individual warm and cold air circulator, and a first compressor having a capacity corresponding to 60% of the total compressor capacity and a second compressor having a capacity corresponding to 40% of the total compressor capacity provided in an outdoor unit, comprising: inputting an operation capacity of the compressors; setting a superheating temperature of the individual warm and cold air circulator to a relatively low value when the operation capacity is large, and setting the superheating temperature of the individual warm and cold air circulator to a relatively high value when the operation capacity is small; and controlling the amount of the refrigerant supplied to the individual warm and cold air circulator according to the superheating temperature.

The control of the amount of the refrigerant may be performed so that a difference of temperatures between the refrigerant supplied to an indoor heat exchanger of the individual warm and cold air circulator and the refrigerant discharged from the indoor heat exchanger of the individual warm and cold air circulator maintains the set superheating temperature.

In the case that at least one of the centralized warm and cold air circulators and the at least one individual warm and cold air circulator are simultaneously operated, when the compressors are selectively operated so that the total operation capacity of the selected compressor(s) corresponds to 100% of the total operation capacity of the compressors, the superheating temperature of the individual warm and cold air circulator may be set to 0° C., when the compressors are selectively operated so that the total operation capacity of the selected compressor(s) corresponds to 60% of the total operation capacity of the compressors, the superheating temperature of the individual warm and cold air circulator may be set to 1° C., and when the compressors are selectively operated so that the total operation capacity of the selected compressor(s) corresponds to 40% of the total operation capacity of the compressors, the superheating temperature of the individual warm and cold air circulator may be set to 2° C.; and in the case that only the at least one individual warm and cold air circulator is operated, when the compressors are selectively operated so that the total operation capacity of the selected compressor(s) corresponds to 40% of the total operation capacity of the compressors, the superheating temperature of the individual warm and cold air circulator may be set to 3° C.

The control of the amount of the refrigerant may be performed so that a difference of temperatures between the refrigerant supplied to an indoor heat exchanger of the individual warm and cold air circulator and the refrigerant discharged from the indoor heat exchanger of the individual warm and cold air circulator maintains the set superheating temperature.

The centralized warm and cold air circulators may be independently installed in corresponding regions of a building, in which the dual type unitary air conditioner is installed, so that the number of the centralized warm and cold air circulators coincides with the number of the regions, and be independently connected in parallel to an outdoor heat exchanger.

The individual warm and cold air circulator may be independently installed in a designated place, and be independently connected in parallel to an outdoor heat exchanger.

Since the superheating temperature of the individual warm and cold air circulator is set differently according to the operating state of the compressors so that the amount of the refrigerant supplied to the individual warm and cold air circulator independently provided in a designated place is appropriately maintained, the method of the present invention forms the optimized refrigerant cycle.

Further, since electric valves are controlled so that the capacity of the individual warm and cold air circulator is maximized within a range in which the supercooled state of the refrigerant is prevented so that the individual warm and cold air circulator provided in a region having centralized warm and cold air circulators installed therein satisfies a user's intention, the method of the present invention improves a consumer's reliability of the dual type unitary air conditioner.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the annexed drawings.

Figure 1:
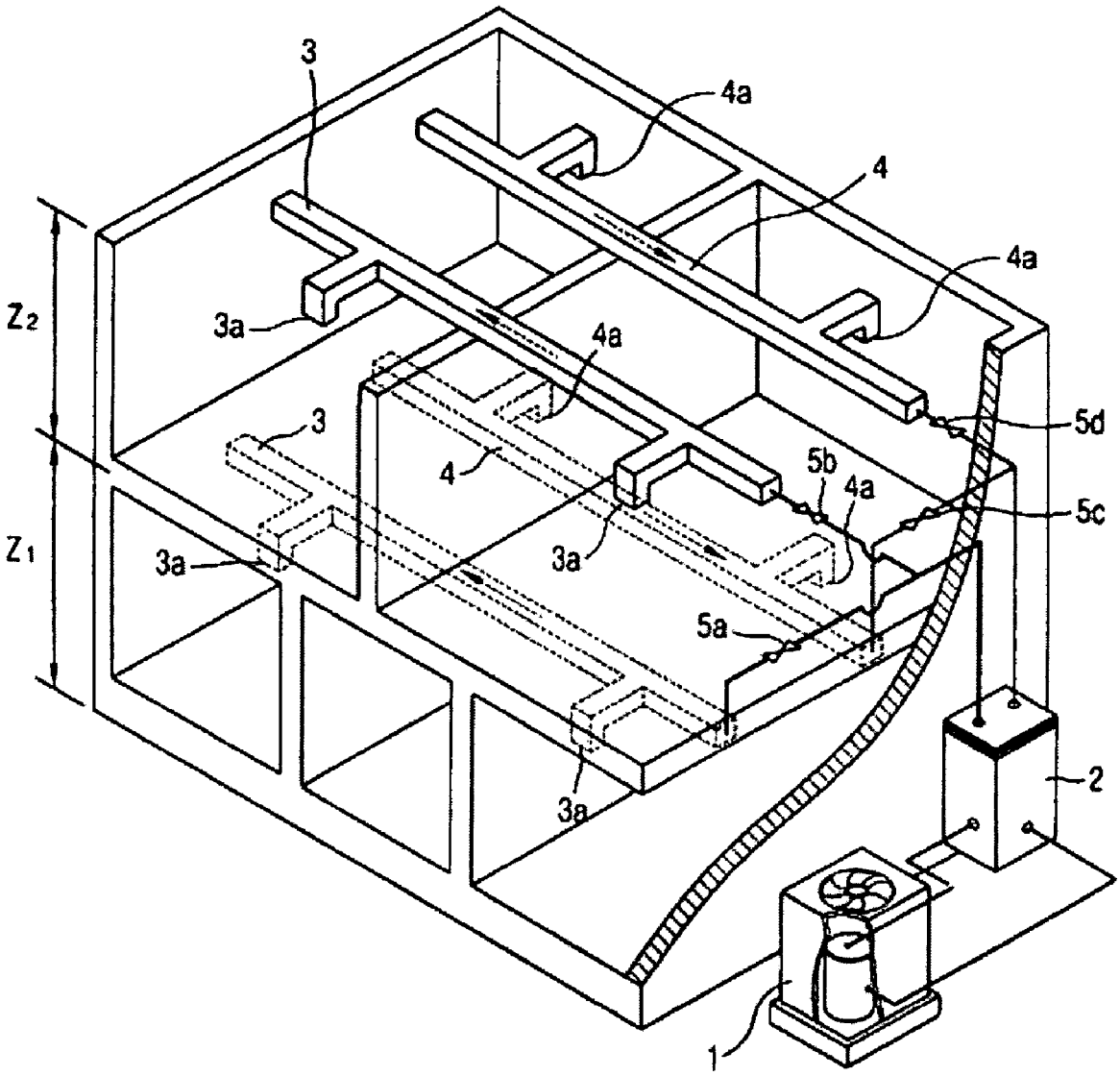
FIG. 1 (related art)
FIG. 1 is a schematic view of a conventional unitary air conditioner.
Figure 2:
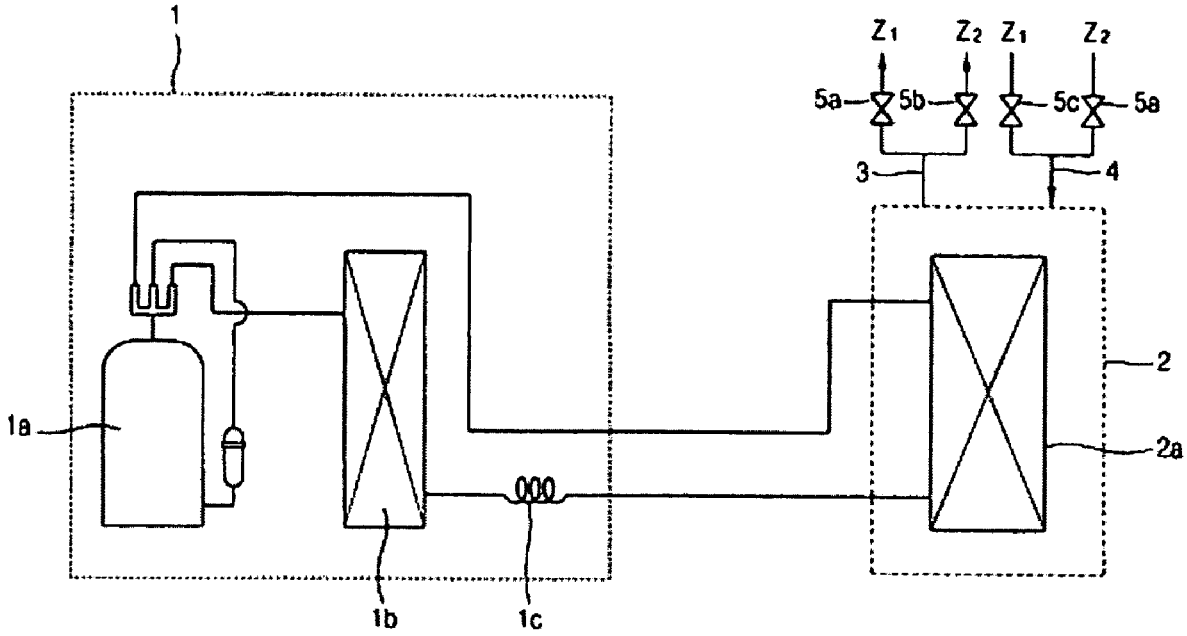
FIG. 2 (related art)
FIG. 2 is a circuit diagram of the conventional unitary air conditioner.
Figure 3:
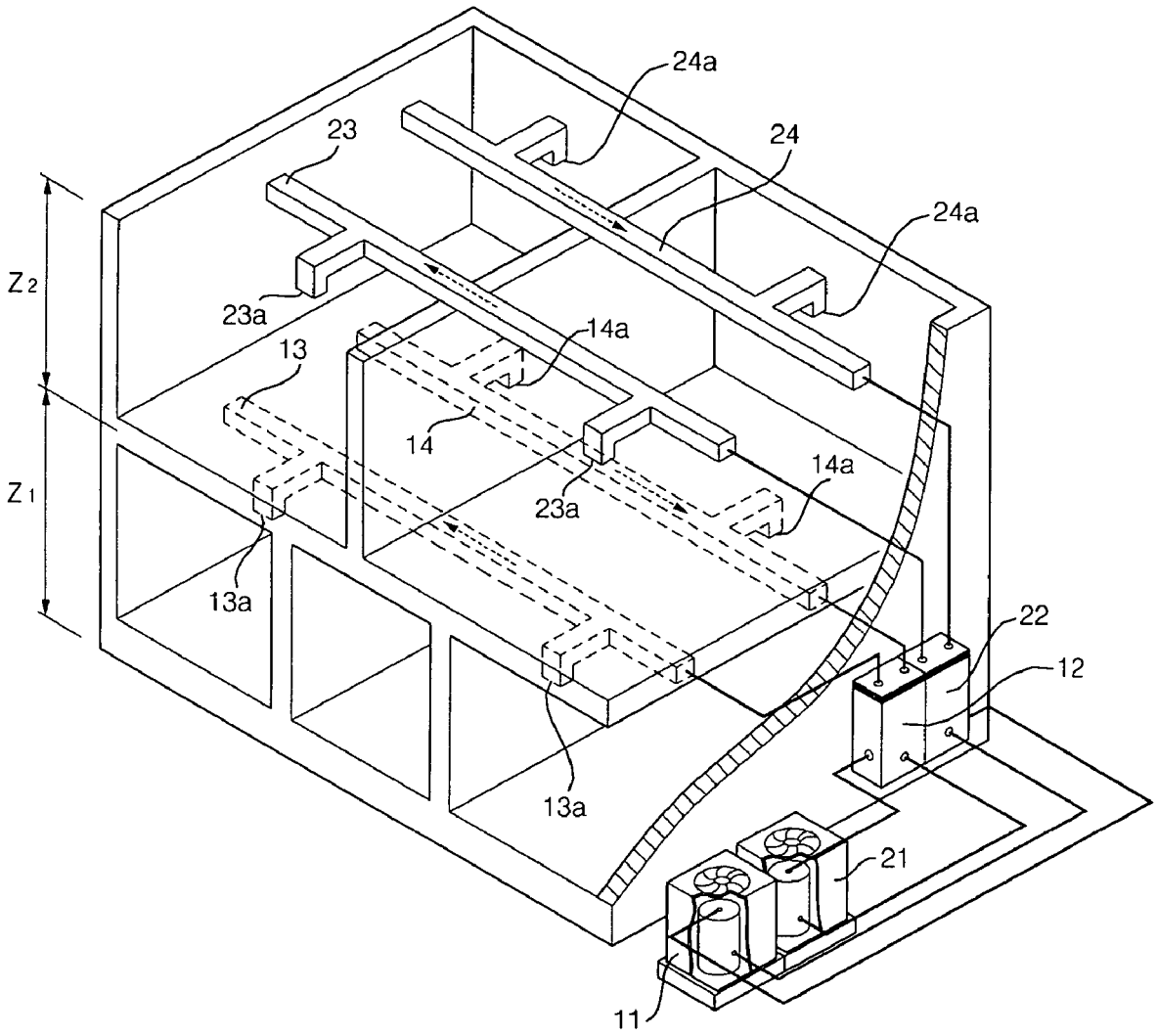
FIG. 3(related art)
FIG. 3 is a schematic view of another conventional unitary air conditioner.
Figure 4:
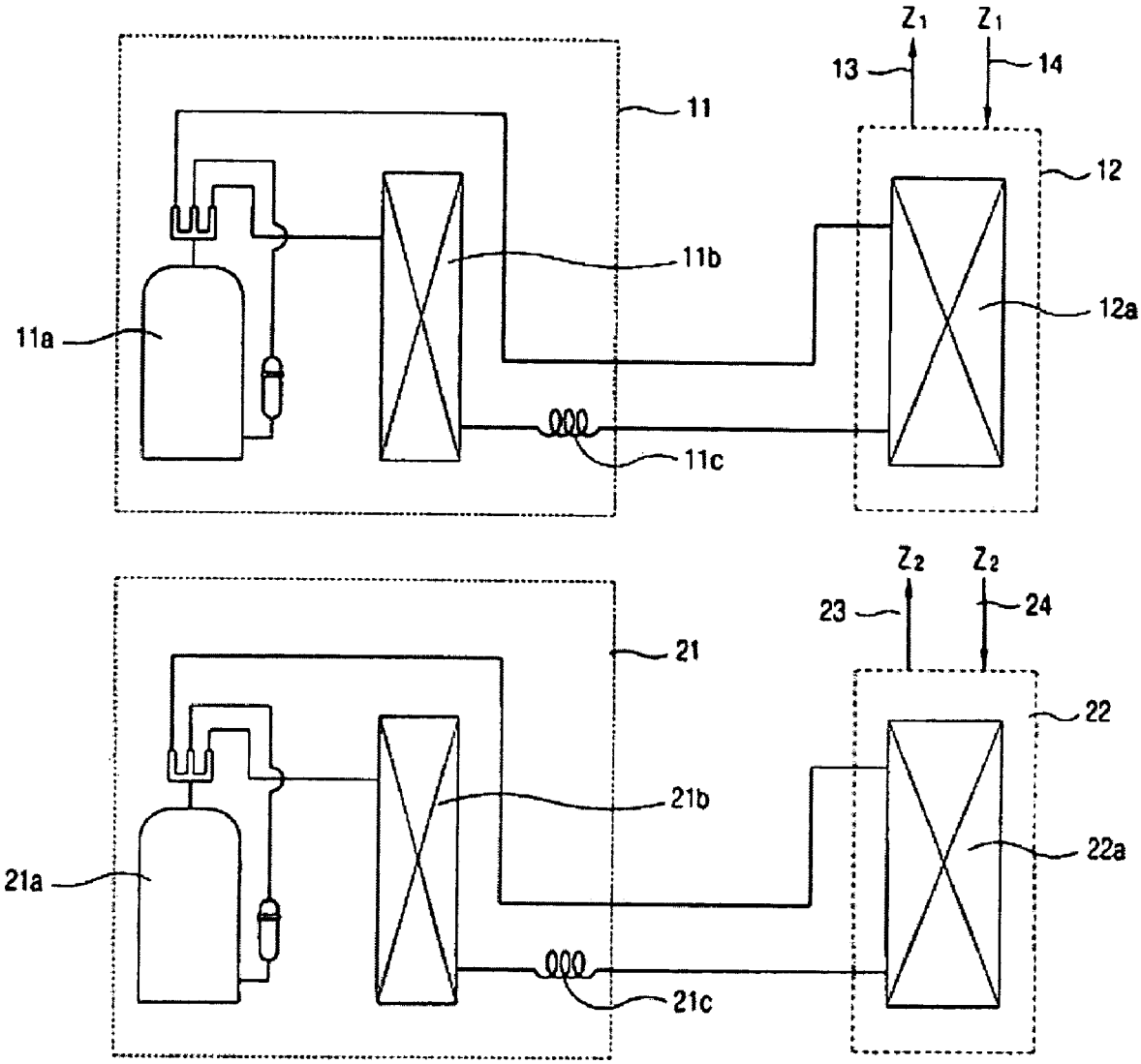
FIG. 4 (related art)
FIG. 4 is a circuit diagram of the conventional unitary air conditioner.
Figure 5:
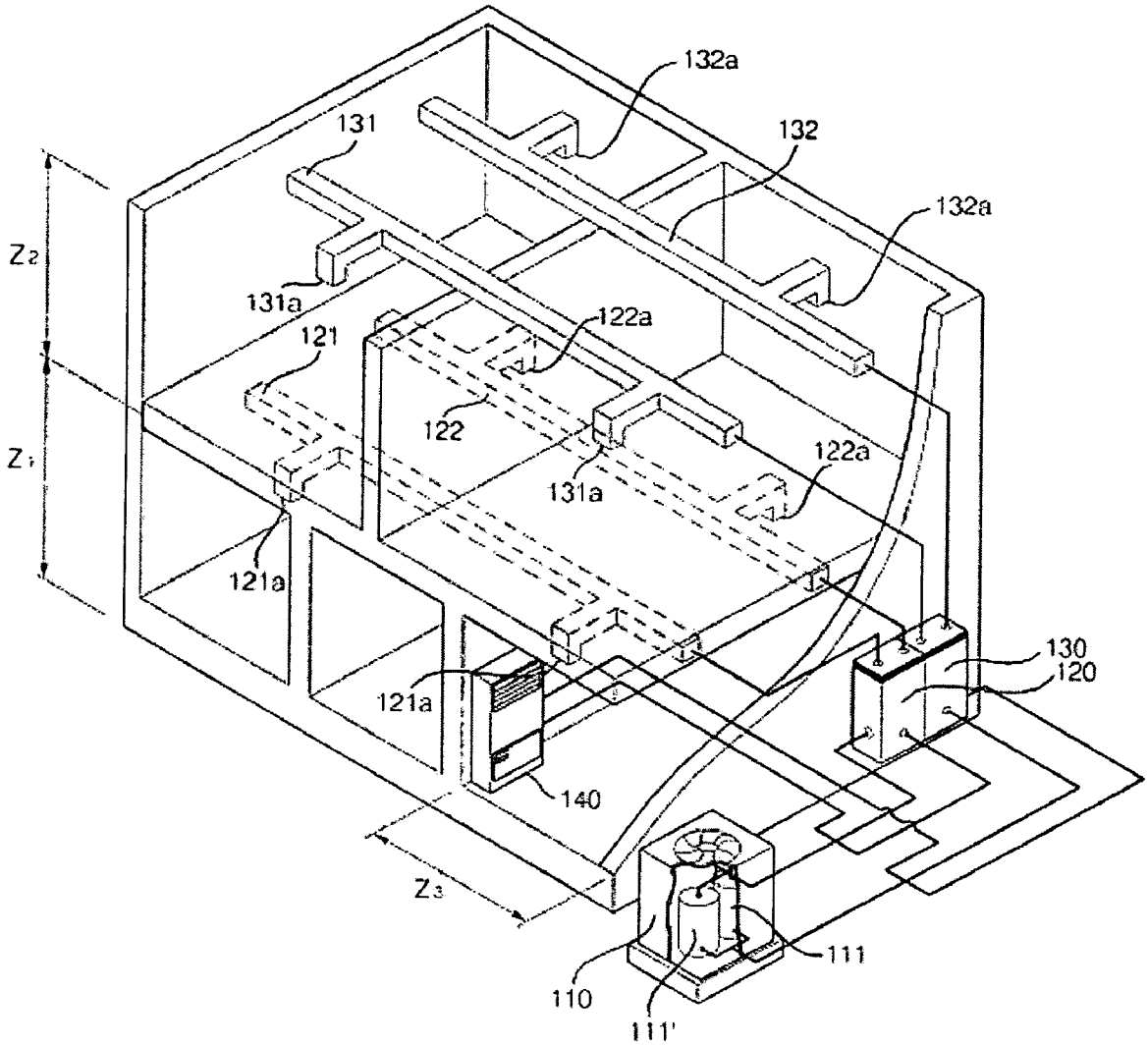
FIG. 5 is a schematic view of a dual type unitary air conditioner in accordance with the present invention.
Figure 6:
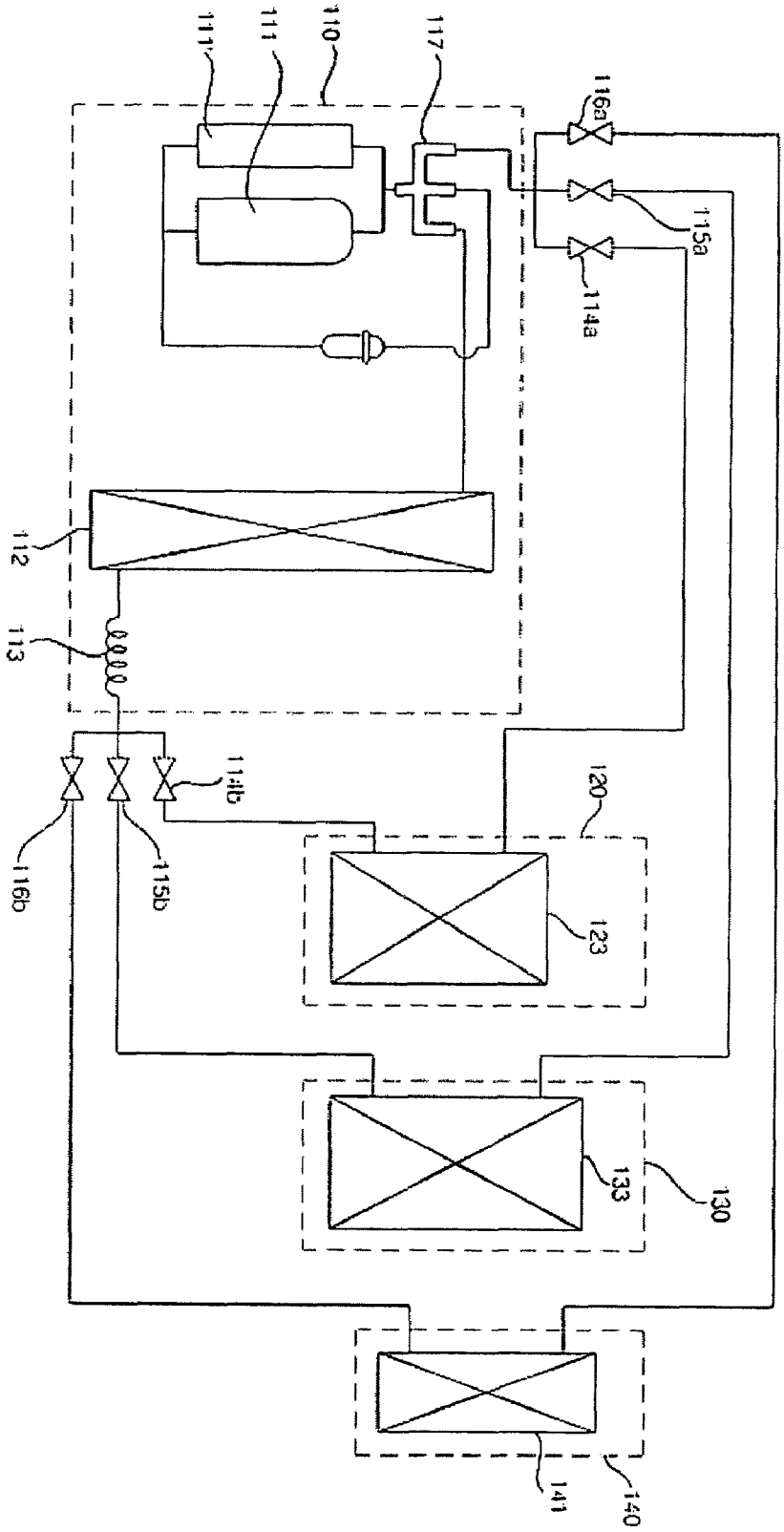
FIG. 6 is a circuit diagram of the dual type unitary air conditioner in accordance with the present invention.
Figure 7:
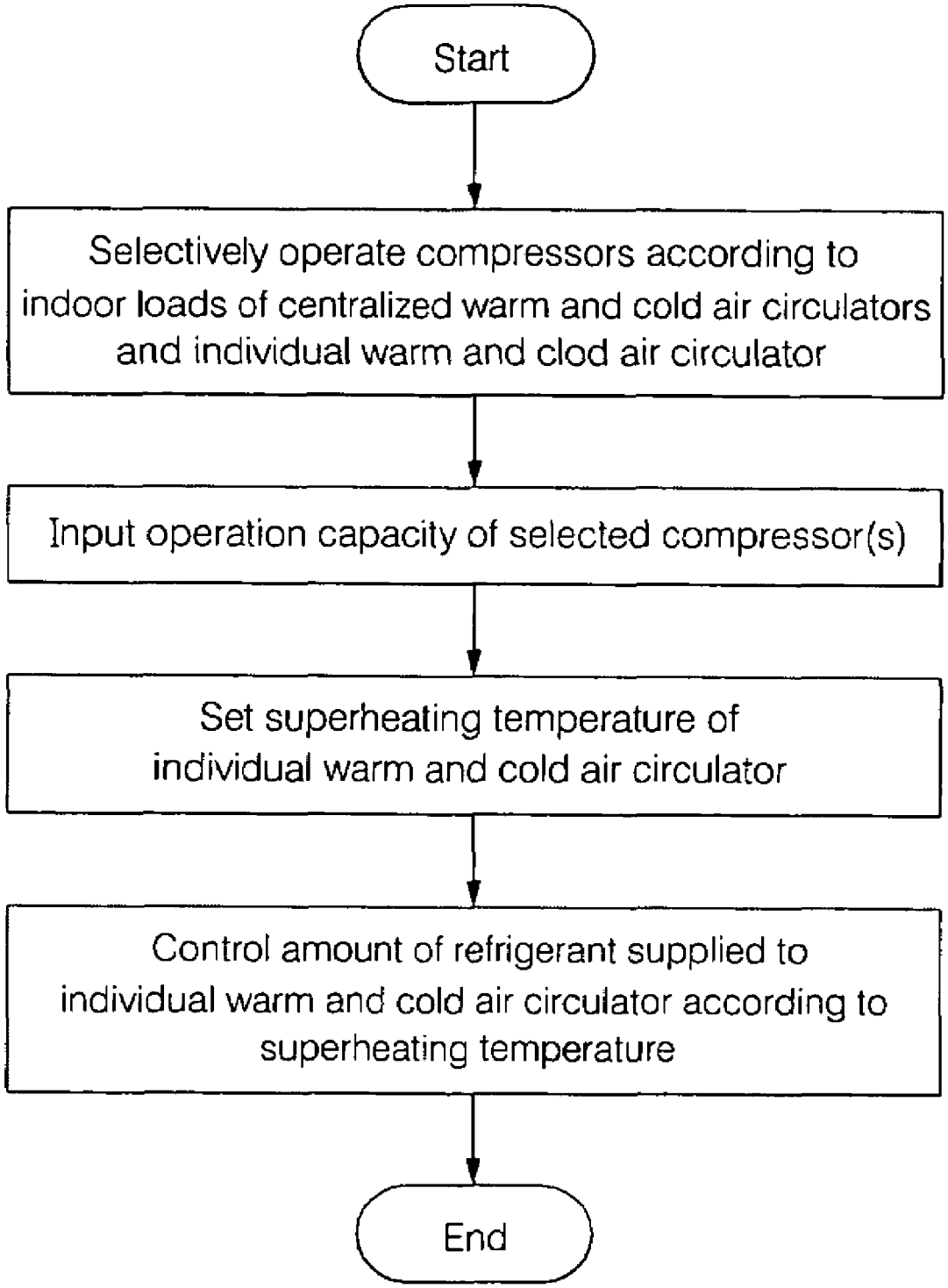
FIG. 7 is a flow chart illustrating a method for controlling the amount of a refrigerant of the dual type unitary air conditioner in accordance with the present invention.

FIG. 5 is a schematic view of a dual type unitary air conditioner in accordance with the present invention, FIG. 6 is a circuit diagram of the dual type unitary air conditioner in accordance with the present invention, and FIG. 7 is a flow chart illustrating a method for controlling the amount of a refrigerant of the dual type unitary air conditioner in accordance with the present invention.

As shown in FIGS. 5 and 6, the dual type unitary air conditioner in accordance with the present invention comprises one outdoor unit 110 fixedly installed at the outside of a building, a plurality of centralized warm and cold air circulators 120 and 130 connected to the outdoor unit 110 and installed in an indoor chamber of the building, such as a basement or an outbuilding, and an individual warm and cold air circulator 140 connected to the outdoor unit 110 and installed at a designated space of the building, such as a kitchen or an attic.

Preferably, the individual warm and cold air circulator 140 is configured using a free joint method so that the individual warm and cold air circulator 140 is easily attachable and detachable as occasion demands.

The outdoor unit 110 comprises a first compressor 111 having a capacity corresponding to 60% of the total compressor capacity, a second compressor 111' having a capacity corresponding to 40% of the total compressor capacity, an outdoor heat exchanger 112 installed at one side of the first and second compressors 111 and 111', an expansion device 113 connected to the outdoor heat exchanger 112 for decompressing and expanding a refrigerant, and a blast fan (not shown) installed at one side of the outdoor heat exchanger 112 for sucking external air and discharging the air to the outdoor heat exchanger 112.

Although the outdoor unit 110 of the air conditioner of the present invention comprises two compressors 111 and 111', three or more compressors may be connected in parallel in consideration of the dimensions of the building. Preferably, in order to reduce a power consumption rate of the air conditioner and to stably maintain the operation of the air conditioner, the compressors 111 and 111', which are connected in parallel, are compressors operated by different methods, i.e., an inverter-operated compressor and a constant-speed compressor. In this case, it is preferable that the two compressors 111 and 111', which are operated by different methods, have different capacities so as to variously adjust the amount of air discharged from the air conditioner according to operating conditions.

Further, preferably, a directional selecting valve 117, i.e., a four-way valve, for selecting the circulation order of the refrigerant so that the air conditioner can be used as a heat pump, such as a warm air circulator or a cold air circulator, is installed at the output side of the first and second compressors 111 and 111'.

Refrigerant pipes, which prepared in the number the same as the number of indoor heat exchangers 123, 133, and 141, which will be described later, and are connected in parallel, are connected to the inlet side and the outlet side of the outdoor heat exchanger 112, and refrigerant control valves 114*a*, 114*b*, 115*a*, 115*b*, 116*a*, and 116*b* for controlling the circulated amount of the refrigerant are installed in the refrigerant pipes. Preferably, the refrigerant control valves 114*a*, 114*b*, 115*a*, 115*b*, 116*a*, and 116*b* are electric valves for automatically adjusting the opening degrees of the refrigerant pipes by a controller.

The expansion device 113 may use an orifice tube, or an electric valve for adjusting the opening degrees of the refrigerant pipes, as occasion demands.

Preferably, the number of the centralized warm and cold air circulators 120 and 130 corresponds to the number of regions $Z_1$ and $Z_2$ of the building so that the centralized warm and cold air circulators 120 and 130 are independently connected to the regions $Z_1$ and $Z_2$. When the two-story building is divided into two regions $Z_1$ and $Z_2$ according to stories, air supply ducts 121 and 131 and air discharge ducts 122 and 132 are independently buried in the walls of the respective stories and are independently installed in the casings of the centralized warm and cold air circulators 120 and 130.

Air channels (not shown) having an approximately U shape, which are respectively connected to the air supply ducts 121 and 131 and the air discharge ducts 122 and 132, are respectively installed in the casings of the centralized warm and cold air circulators 120 and 130. The first indoor heat exchangers 123 and 133 are respectively installed at the inlet sides of the air channels, and first air supply fans (not shown) for circulating warm air or cold air from the air supply ducts 121 and 131 to the air discharge ducts 122 and 132 are respectively installed at the lower streams of the first indoor heat exchangers 123 and 133.

The first indoor heat exchangers 123 and 133 are independently connected in parallel to the outdoor heat exchanger 112 of the outdoor unit 110 so that each of the first indoor heat exchangers 123 and 133 and the outdoor heat exchanger 112 forms a closed curved line. Designated sides of the first indoor heat exchangers 123 and 133 are connected in parallel to the expansion device 113.

The individual warm and cold air circulator 140 may have various structures, such as a wall-mounted structure, a slim structure, and a ceiling-mounted structure. The individual warm and cold air circulator 140 comprises a second indoor heat exchanger 141 installed in a casing and connected to the outdoor heat exchanger 112, and a second air supply fan (not shown) installed at the lower stream of the second indoor heat exchanger 141.

The above dual type unitary air conditioner of the present invention will be operated, as follows.

For example, in a two-story house, in a cooling mode, a part or all of the first and second compressors 111 and 111' are selected and operated to compress a refrigerant into a high-temperature and high-pressure gaseous state. The refrigerant in the gaseous state is supplied to the outdoor heat exchanger 112 through the directional selecting valve 117 and condensed into a high-temperature and high-pressure liquid state by the outdoor heat exchanger 112, and the refrigerant passes through the expansion device 113. Thereby, the refrigerant is converted into a low-temperature and low-pressure state, and simultaneously, the electric valves 114*a*, 114*b*, 115*a*, and 115*b* of the refrigerant pipes connected to the first indoor heat exchangers 123 and 133 of the centralized warm and cold air circulators 120 and 130 are opened so that the condensed refrigerant is divided into the refrigerant pipes, supplied to the first indoor heat exchangers 123 and 133, and evaporated by the first indoor heat exchangers 123 and 133, thereby generating cold air. The cold air is transferred to the air supply ducts 121 and 131 by the air supply fans (not shown), and is supplied to the respective regions $Z_1$ and $Z_2$ through discharge holes 121*a* and 131*a*. On the other hand, warm air in the respective regions $Z_1$ and $Z_2$ is sucked into the air discharge ducts 122 and 132 through suction holes 122*a* and 123*a*, is transferred along the air channels of the centralized warm and cold air circulators 120 and 130, and passes through the first indoor heat exchangers 123 and 133, thereby changed into cold air. Then, the cold air is circulated to the air supply ducts 121 and 131. The above circulation process is repeated. Here, the refrigerant passing through the first indoor heat exchangers 123 and 133 is evaporated by absorbing heat from indoor air, and is supplied again to the first and second compressors 111 and 111'.

In order to heat or cool a space having a high load of the respective regions $Z_1$ and $Z_2$, such as a kitchen or an attic, the corresponding electric valves 116*a* and 116*b* are opened. Then, the refrigerant in the low-temperature and low-pressure gaseous state, having passed through the outdoor heat exchanger 112 and the expansion device 113, is transferred to the second indoor heat exchanger 141 of the individual warm and cold air circulator 140 through the refrigerant pipe connected to the second indoor heat exchanger 141, and passes through the second indoor heat exchanger 141, thereby generating cold air. The cold air is additionally supplied to the corresponding region $Z_3$ by the second air supply fan (not shown), thereby additionally cooling the region $Z_3$.

Here, the amounts of the refrigerant supplied to the indoor heat exchangers 123 and 133 of the centralized warm and cold air circulators 120 and 130 and the indoor heat exchanger 141 of the individual warm and cold air circulator 140 are respectively controlled by whether or not the electric valves 114*a*, 114*b*, 115*a*, 115*b*, 116*a*, and 116*b* located at inlets and outlets of the indoor heat exchangers 123, 133, and 141 are opened.

Whether or not the electric valves 114*a*, 114*b*, 115*a*, 115*b*, 116*a*, and 116*b* are opened and the opening degrees of the electric valves 114*a*, 114*b*, 115*a*, 115*b*, 116*a*, and 116*b* are respectively controlled by comparing differences of temperatures between the refrigerant supplied to the indoor heat exchangers 123, 133, and 141 and the refrigerant discharged from the indoor heat exchangers 123, 133, and 141 to a predetermined value (hereinafter, referred to as a "superheating temperature"). That is, when the differences of temperatures between the refrigerant supplied to the indoor heat exchangers 123, 133, and 141 and the refrigerant discharged from the indoor heat exchangers 123, 133, and 141 are smaller than the superheating temperature, the refrigerant in the supercooled liquid state is supplied to the compressors 111 and 111'. Accordingly, in this case, pulse values of the electric valves 114*a*, 114*b*, 115*a*, 115*b*, 116*a*, and 116*b* are reduced so that the amount of the refrigerant supplied to the indoor heat exchangers 123, 133, and 141 is decreased, thereby releasing the supercooled state of the refrigerant. On the other hand, when the differences of temperatures between the refrigerant supplied to the indoor heat exchangers 123, 133, and 141 and the refrigerant discharged from the indoor heat exchangers 123, 133, and 141 are larger than the superheating temperature, the indoor heat exchangers 123, 133, and 141 are in an overloaded state. Accordingly, in this case, the pulse values of the electric valves 114*a*, 114*b*, 115*a*, 115*b*, 116*a*, and 116*b* are enlarged so that the amount of the refrigerant supplied to the indoor heat exchangers 123, 133, and 141 is increased, thereby releasing the overloaded state of the indoor heat exchangers 123, 133, and 141.

Here, the superheating temperature of the individual warm and cold air circulator 140 is determined by whether or not the centralized warm and cold air circulators 120 and 130 and the individual warm and cold air circulator 140 are operated and the operating states of the first and second compressors 111 and 111', as follows.

First, a part or all of the first and second compressors 111 and 111' are selectively operated according to indoor loads of the centralized warm and cold air circulators 120 and 130 and the individual warm and cold air circulator 140 (S10). All combinations of loads of the regions Z1 and Z2 having the centralized warm and cold air circulators 120 and 130 installed therein and corresponding to one, selected from the group consisting of a signal Y2 indicating the supply of a large amount of air, a signal Y1 indicating the supply of a small amount of air, and a signal 0 indicating non supply of air in a 2-stage system, and a load of the region Z3 having the individual warm and cold air circulator 140 installed therein and inputted in an ON/OFF system, and the operation of the first and second compressors 111 and 111' according to the combinations are shown in the below Table.

| | Z1 | Z2 | Z3 | Total operation capacity of selected compressor(s) (%) | Superheating temperature (° C.) |
|---|---|---|---|---|---|
| 1 | Y2 | Y2 | ON | 100 | 0 |
| 2 | Y2 | Y2 | OFF | 100 | |
| 3 | Y2 | Y1 | ON | 100 | 0 |

-continued

| | Z1 | Z2 | Z3 | Total operation capacity of selected compressor(s) (%) | Superheating temperature (° C.) |
|---|---|---|---|---|---|
| 4 | Y2 | Y1 | OFF | 60 | |
| 5 | Y2 | 0 | ON | 60 | 1 |
| 6 | Y2 | 0 | OFF | 40 | |
| 7 | Y1 | Y2 | ON | 100 | 0 |
| 8 | Y1 | Y2 | OFF | 60 | |
| 9 | Y1 | Y1 | ON | 60 | 1 |
| 10 | Y1 | Y1 | OFF | 60 | |
| 11 | Y1 | 0 | ON | 40 | 2 |
| 12 | Y1 | 0 | OFF | 40 | |
| 13 | 0 | Y2 | ON | 60 | 1 |
| 14 | 0 | Y2 | OFF | 40 | |
| 15 | 0 | Y1 | ON | 40 | 2 |
| 16 | 0 | Y1 | OFF | 40 | |
| 17 | 0 | 0 | ON | 40 | 3 |

Then, the total operation capacity of the selected compressor(s) is inputted (S20). When the inputted total operation capacity is large, the superheating temperature of the individual warm and cold air circulator 140 is set to a comparatively low value, and when the inputted total operation capacity is small, the superheating temperature of the individual warm and cold air circulator 140 is set to a comparatively high value (S30).

That is, as stated in the above Table, when all of the first and second compressors 111 and 111' are operated (when the total operation capacity of the selected compressor(s) corresponds to 100% of the total operation capacity of the compressors), the superheating temperature of the individual warm and cold air circulator 140 is set to 0° C., when only the first compressor 111 is operated (when the total operation capacity of the selected compressor(s) corresponds to 60% of the total operation capacity of the compressors), the superheating temperature of the individual warm and cold air circulator 140 is set to 1° C., and when only the second compressor 111' is operated (when the total operation capacity of the selected compressor(s) corresponds to 40% of the total operation capacity of the compressors), the superheating temperature of the individual warm and cold air circulator 140 is set to 2° C. Although only the second compressor 111' is operated (when the total operation capacity of the selected compressor(s) corresponds to 40% of the total operation capacity of the compressors), when only the individual warm and cold air circulator 140 is operated, the superheating temperature of the individual warm and cold air circulator 140 is set to 3° C.

Accordingly, when all of the compressors 111 and 111' are operated so that the total operation capacity of the selected compressor(s) corresponds to 100% of the total operation capacity of the compressors and a part or all of the centralized warm and cold air circulators 120 and 130 and the individual warm and cold air circulator 140 are simultaneously operated, the expanded refrigerant is divided into the operating centralized warm and cold air circulator(s) 120 and/or 130 and the individual warm and cold air circulator 140, the amount of the refrigerant supplied to the individual warm and cold air circulator 140 is not sufficient. Thus, the efficiency of the individual warm and cold air circulator 140 can be reduced by approximately 20%. However, when the superheating temperature of the individual warm and cold air circulator 140 for controlling the amount of the refrigerant is set to a relatively low value as described above, pulses of the refrigerant valves 116*a* and 116*b* of the individual warm and cold air circulator 140 are relatively increased so that a relatively large amount of the refrigerant is supplied to the individual warm and cold air circulator 140, thereby releasing the overloaded state of the individual warm and cold air circulator 140. This allows the individual warm and cold air circulator 140 to exhibit a sufficient capacity so that the region $Z_3$ can be rapidly heated and cooled, and satisfies a user's intention for installing the individual warm and cold air circulator 140.

On the other hand, when none of the first and second compressors 111 and 111' are operated, a relatively large amount of the refrigerant is supplied to the individual warm and cold air circulator 140, and the refrigerant does not sufficiently exchange heat with indoor air in the indoor heat exchanger 141. Thereby, the supplied refrigerant in a supercooled state passes through the indoor heat exchanger 141, and the refrigerant in a liquid state is supplied to the compressors 111 and 111'. However, when the superheating temperature of the individual warm and cold air circulator 140 for controlling the refrigerant is increased to 3° C., pulses of the refrigerant valves 116*a* and 116*b* of the individual warm and cold air circulator 140 are decreased so that a small amount of the refrigerant is supplied to the individual warm and cold air circulator 140, thereby releasing the supercooled state of the refrigerant.

Further, when the compressors 111 and 111' are selectively operated so that the total operation capacity of the selected compressor(s) corresponds to 60% or 40% of the total operation capacity of the compressors according to loads of the centralized warm and cold air circulators 120 and 130 and the individual warm and cold air circulator 140, the superheating temperature of the individual warm and cold air circulator 140 is set to 1° C. or 2° C. so that the appropriate amount of the refrigerant is supplied to the individual warm and cold air circulator 140 (S40).

Although not stated in a separate Table, even when the dual type unitary air conditioner of the present invention comprises the centralized warm and cold air circulators prepared in different number, the individual warm and cold air circulators prepared in different number, and the compressors prepared in different number, it is possible to appropriately control the amount of the refrigerant supplied to the individual warm and cold air circulators by controlling the electric valves according to the predetermined superheating temperatures of the individual warm and cold air circulators.

For reference, the operation of the dual type unitary air conditioner in a heating mode is the same as that in the cooling mode except that the circulation of the refrigerant in the heating mode is performed in the reverse order according to a heat pump-type refrigerating cycle.

As apparent from the above description, the present invention provides a method for controlling the amount of a refrigerant of a dual type unitary air conditioner, in which the superheating temperature of an individual warm and cold air circulator is set differently according to the operating state of compressors so that the amount of the refrigerant supplied to the individual warm and cold air circulator independently provided in a designated place is appropriately maintained, thereby forming the optimized refrigerant cycle.

Further, since electric valves are controlled so that the capacity of the individual warm and cold air circulator is maximized within a range in which the supercooled state of the refrigerant is prevented so that the individual warm and cold air circulator provided in a region having centralized warm and cold air circulators installed therein satisfies a user's intention, the method of the present invention improves a consumer's reliability of the dual type unitary air conditioner.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A method for controlling the amount of a refrigerant of a dual type unitary air conditioner, which has a plurality of centralized warm and cold air circulators and at least one individual warm and cold air circulator, comprising:

inputting an operation capacity of compressors of an outdoor unit of the dual type unitary air conditioner;

setting a superheating temperature of the individual warm and cold air circulator to a relatively low value when the operation capacity is large, and setting the superheating temperature of the individual warm and cold air circulator to a relatively high value when the operation capacity is small; and controlling the amount of the refrigerant supplied to the individual warm and cold air circulator according to the superheating temperature.

2. The method as set forth in claim 1, wherein the control of the amount of the refrigerant is performed so that a difference of temperatures between the refrigerant supplied to an indoor heat exchanger of the individual warm and cold air circulator and the refrigerant discharged from the indoor heat exchanger of the individual warm and cold air circulator maintains the set superheating temperature.

3. The method as set forth in claim 1, wherein the centralized warm and cold air circulators are independently installed in corresponding regions of a building, in which the dual type unitary air conditioner is installed, so that the number of the centralized warm and cold air circulators coincides with the number of the regions, and are independently connected in parallel to an outdoor heat exchanger.

4. The method as set forth in claim 1, wherein the individual warm and cold air circulator is independently installed in a designated place, and is independently connected in parallel to an outdoor heat exchanger.

5. The method as set forth in claim 1, wherein a plurality of the compressors individually or simultaneously operated according to a load in the building are connected in parallel.

6. The method as set forth in claim 5, wherein a plurality of the compressors have different capacities.

7. The method as set forth in claim 5, wherein a plurality of the compressors are operated by different methods.

8. A method for controlling the amount of a refrigerant of a dual type unitary air conditioner, which has a plurality of centralized warm and cold air circulators independently installed in corresponding regions of a building, in which the dual type unitary air conditioner is installed, so that the number of the centralized warm and cold air circulators coincides with the number of the regions, and independently connected in parallel to an outdoor heat exchanger, and at least one individual warm and cold air circulator independently installed in a designated place and independently connected in parallel to the outdoor heat exchanger, comprising:

inputting an operation capacity of compressors of an outdoor unit of the dual type unitary air conditioner;

setting a superheating temperature of the individual warm and cold air circulator to a relatively low value when the operation capacity is large, and setting the superheating temperature of the individual warm and cold air circulator to a relatively high value when the operation capacity is small; and controlling the amount of the refrigerant supplied to the individual warm and cold air circulator according to the superheating temperature.

9. The method as set forth in claim 8, wherein the control of the amount of the refrigerant is performed so that a difference of temperatures between the refrigerant supplied to an indoor heat exchanger of the individual warm and cold air circulator and the refrigerant discharged from the indoor heat exchanger of the individual warm and cold air circulator maintains the set superheating temperature.

10. The method as set forth in claim 8, wherein a plurality of the compressors individually or simultaneously operated according to a load in the building are connected in parallel.

11. The method as set forth in claim 10, wherein a plurality of the compressors have different capacities.

12. The method as set forth in claim 10, wherein a plurality of the compressors are operated by different methods.

13. The method as set forth in claim 8, wherein:

the compressors comprise a first compressor having a capacity corresponding to 60% of the total compressor capacity, and a second compressor having a capacity corresponding to 40% of the total compressor capacity;

in the case that at least one of the centralized warm and cold air circulators and the at least one individual warm and cold air circulator are simultaneously operated, when the compressors are selectively operated so that the total operation capacity of the selected compressor(s) corresponds to 100% of the total operation capacity of the compressors, the superheating temperature of the individual warm and cold air circulator is set to 0° C., when the compressors are selectively operated so that the total operation capacity of the selected compressor(s) corresponds to 60% of the total operation capacity of the compressors, the superheating temperature of the individual warm and cold air circulator is set to 1° C., and when the compressors are selectively operated so that the total operation capacity of the selected compressor(s) corresponds to 40% of the total operation capacity of the compressors, the superheating temperature of the individual warm and cold air circulator is set to 2° C.; and in the case that only the at least one individual warm and cold air circulator is operated, when the compressors are selectively operated so that the total operation capacity of the selected compressor(s) corresponds to 40% of the total operation capacity of the compressors, the superheating temperature of the individual warm and cold air circulator is set to 3° C.

14. The method as set forth in claim 13, wherein the control of the amount of the refrigerant is performed so that a difference of temperatures between the refrigerant supplied to an indoor heat exchanger of the individual warm and cold air circulator and the refrigerant discharged from the indoor heat exchanger of the individual warm and cold air circulator maintains the set superheating temperature.

15. A method for controlling the amount of a refrigerant of a dual type unitary air conditioner, which has a plurality of centralized warm and cold air circulators, at least one individual warm and cold air circulator, and a first compressor having a capacity corresponding to 60% of the total compressor capacity and a second compressor having a capacity corresponding to 40% of the total compressor capacity provided in an outdoor unit, comprising:

inputting an operation capacity of the compressors;

setting a superheating temperature of the individual warm and cold air circulator to a relatively low value when the operation capacity is large, and setting the superheating temperature of the individual warm and cold air circulator to a relatively high value when the operation capacity is small; and controlling the amount of the refrigerant supplied to the individual warm and cold air circulator according to the superheating temperature.

16. The method as set forth in claim 15, wherein the control of the amount of the refrigerant is performed so that a difference of temperatures between the refrigerant supplied to an indoor heat exchanger of the individual warm and cold air circulator and the refrigerant discharged from the indoor heat exchanger of the individual warm and cold air circulator maintains the set superheating temperature.

17. The method as set forth in claim 15, wherein:

in the case that at least one of the centralized warm and cold air circulators and the at least one individual warm and cold air circulator are simultaneously operated, when the compressors are selectively operated so that the total operation capacity of the selected compressor(s) corresponds to 100% of the total operation capacity of the compressors, the superheating temperature of the individual warm and cold air circulator is set to 0° C., when the compressors are selectively operated so that the total operation capacity of the selected compressor(s) corresponds to 60% of the total operation capacity of the compressors, the superheating temperature of the individual warm and cold air circulator is set to 1° C., and when the compressors are selectively operated so that the total operation capacity of the selected compressor(s) corresponds to 40% of the total operation capacity of the compressors, the superheating temperature of the individual warm and cold air circulator is set to 2° C.; and in the case that only the at least one individual warm and cold air circulator is operated, when the compressors are selectively operated so that the total operation capacity of the selected compressor(s) corresponds to 40% of the total operation capacity of the compressors, the superheating temperature of the individual warm and cold air circulator is set to 3° C.

18. The method as set forth in claim 17, wherein the control of the amount of the refrigerant is performed so that a difference of temperatures between the refrigerant supplied to an indoor heat exchanger of the individual warm and cold air circulator and the refrigerant discharged from the indoor heat exchanger of the individual warm and cold air circulator maintains the set superheating temperature.

19. The method as set forth in claim 17, wherein the centralized warm and cold air circulators are independently installed in corresponding regions of a building, in which the dual type unitary air conditioner is installed, so that the number of the centralized warm and cold air circulators coincides with the number of the regions, and are independently connected in parallel to an outdoor heat exchanger.

20. The method as set forth in claim 17, wherein the individual warm and cold air circulator is independently installed in a designated place, and is independently connected in parallel to an outdoor heat exchanger.

* * * * *